US008539964B2

(12) United States Patent
Rong

(10) Patent No.: US 8,539,964 B2
(45) Date of Patent: Sep. 24, 2013

(54) HAIR CURLING TONG

(75) Inventor: Li Jian Rong, Guang Zhou (CN)

(73) Assignee: Eurasia Concepts, Inc., Los Angeles, CA (US)

( * ) Notice: Subject to any disclaimer, the term of this patent is extended or adjusted under 35 U.S.C. 154(b) by 41 days.

(21) Appl. No.: 12/965,601

(22) Filed: Dec. 10, 2010

(65) Prior Publication Data

US 2012/0145180 A1 Jun. 14, 2012

(51) Int. Cl.
*A45D 2/00* (2006.01)

(52) U.S. Cl.
USPC ..... 132/232

(58) Field of Classification Search
USPC ..... 132/232, 229, 231, 233, 237, 238, 132/239, 240–242, 266, 263; 219/222, 225
See application file for complete search history.

(56) References Cited

U.S. PATENT DOCUMENTS

| | | | | |
|---|---|---|---|---|
| 1,639,015 | A | 8/1927 | Velten | |
| 1,652,279 | A * | 12/1927 | Jacobs | 132/266 |
| 1,657,306 | A | 1/1928 | Gursky | |
| 2,405,431 | A * | 8/1946 | Kiernan | 132/263 |
| 4,024,375 | A | 5/1977 | Olesen et al. | |
| 4,233,999 | A | 11/1980 | Thomas | |
| 4,365,140 | A | 12/1982 | Bast et al. | |
| 4,442,849 | A | 4/1984 | Kawabe | |
| 4,469,934 | A | 9/1984 | Isshiki et al. | |
| 4,591,695 | A | 5/1986 | Inoue | |
| 5,649,555 | A | 7/1997 | Harris | |
| 6,554,000 | B2 * | 4/2003 | Lin | 132/232 |
| 7,271,368 | B2 | 9/2007 | Yeung | |

FOREIGN PATENT DOCUMENTS

CN 101766389 A 7/2010

* cited by examiner

*Primary Examiner* — Rachel Steitz
(74) *Attorney, Agent, or Firm* — Christie, Parker & Hale, LLP

(57) ABSTRACT

Hair curling tong (1) with a fixed handle (2) and a heated tube body (12) fixed thereto provided with clamp (17) that is fixed in a tilting way to the curling tong (1) and can be tilted between a closed position wherein the clamp (17) is held in contact with the tube body (12) by means of a spring (18) activated by a button (20) and an open position wherein the clamp is tilted away from the tube body (12), characterized in that the clamp (17) is fixed in a rotatable way to the curling tong (1) by means of a ring (10) which is rotatable over 360° around the longitudinal axis (X-X') of the tube body (12).

12 Claims, 4 Drawing Sheets

HAIR CURLING TONG

FIELD OF THE INVENTION

The present invention relates to a hair curling tong.

BACKGROUND OF THE INVENTION

Traditionally electrical hair curling tongs comprise a tube body that can be heated, equipped with a movable clamp, to grasp a lock of hair between the tube body and the clamp and hold it while the curling tong is rotated to wind the hair in a curly shape after a few moments of heating the hair. The lock of hair is then released, now in a curly shape.

A disadvantage of this kind of traditional electrical hair curling tongs is that the complete curling tong needs to be rotated, which makes it difficult to hold the curling tong in a fixed position and to avoid burns to the scalp by the heated tube body.

Another disadvantage of traditional curling tongs is that the electric cord is rotated also with ensuing torque on the cord, and with hindrance to the rotational movement of the curling tong.

Another disadvantage of traditional curling tongs is that they cause strain in the arm of the operator, due to the rotation that the entire curling tong needs to make.

SUMMARY OF THE INVENTION

It is an objective of one or more embodiments of the present invention to provide a solution to one or more of the above-mentioned disadvantages.

To this end, various embodiments of the present invention provide a hair curling tong with a fixed handle and a heated tube body fixed thereto provided with a clamp that is fixed in a tilting way to the curling tong and can be tilted between a closed position wherein the clamp is held in contact with the tube body by means of a button activated spring and an open position wherein the clamp is tilted away from the tube body, characterized in that the clamp, and only the clamp, is fixed in a rotatable way to the curling tong by means of a ring which is concentrically rotatable over 360° around the longitudinal axis of the tube body.

An advantage of such a curling tong is that the complete curling tong no longer needs to be rotated, which makes it easier to hold the curling tong in a fixed position and to avoid burns to the scalp by the heated tube body.

Another advantage of such a curling tong is that the electrical connection cord is no longer rotated while curling the hair and thus torque on the cord is avoided, and so is hindrance by the cord to the rotational movement of curling the hair.

Yet another advantage of such a curling tong is that it no longer causes strain in the arm of the operator, since the entire curling tong does not have to be rotated anymore.

Preferably, the ring is realized as a bush with a cylindrical grip, situated adjacent to the fixed handle and rotatable with respect to the fixed handle by fingers of the same hand that holds the fixed handle.

The advantage of the cylindrical grip is that it can be rotated by two fingers and that the movements needed to curl the hair are minimal, while the curling tong can be held steady with the same hand. In this way, strain in the hand and arm of the operator is avoided, and the curling operation is speeded up and moreover the curling operation requires only one hand which means that the other hand is now free for other manipulations.

The grip is preferably made of a thermally insulating material, such as a silicone.

Preferably the clamp is made of a metal, or of a synthetic thermally resistant material.

The advantage of the clamp made in such a material, is that its shape and function are not affected by the heat of the heated tube body.

Preferably, the clamp can be closed or opened by releasing or pushing a button.

The advantage of such a button is that the clamp can be closed or opened by the action of the thumb only and that this button can be operated without having to rotate the curling tong.

In the most preferred embodiment, the heated tube body has a circular cross-section perpendicular to the longitudinal axis.

The advantage of such a circumference is that curls are obtained with a constant curl radius.

In another embodiment, the heated tube body surface has a knurled circular cross-section perpendicular to the longitudinal axis so that the tube body surface shows ribs and grooves stretching in the longitudinal axis of the tube.

The advantage of such a knurled circular cross-section is that curls are obtained with an extra wavy pattern.

BRIEF DESCRIPTION OF THE DRAWINGS

With the intention of better showing the characteristics of the invention, hereafter, by way of example, without intending any limitation thereto, a preferred form of embodiment is described of an improved curling tong, with reference to the accompanying drawings, wherein.

DETAILED DESCRIPTION

Figure 1:
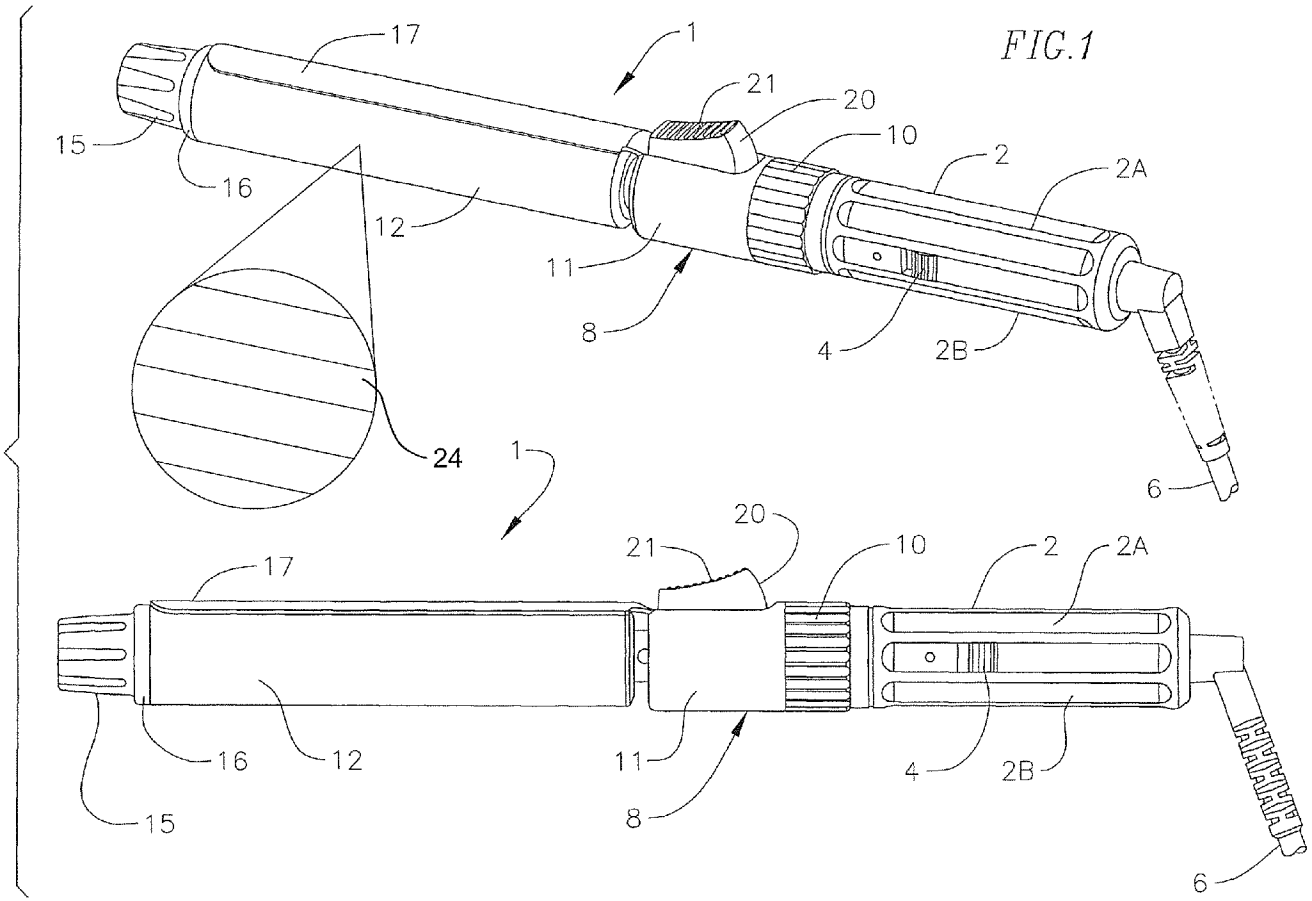
FIG. 1 schematically and in perspective represents a curling tong according to the invention in a non-used position.
Figure 2:
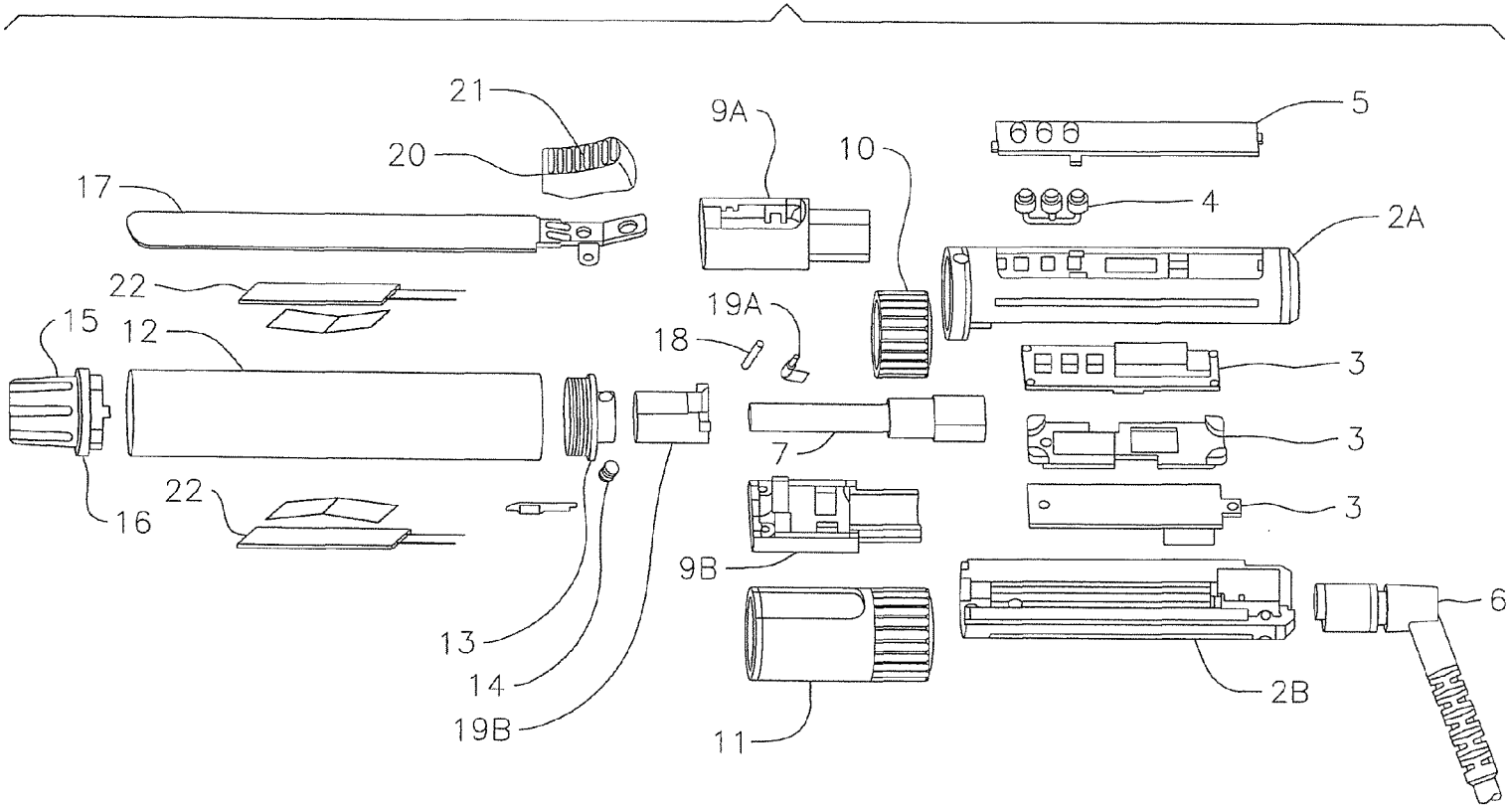
FIG. 2 represents the curling tong in an exploded view.

The curling tong 1 shown in the FIGS. 1 and 2 comprises a fixed handle 2 consisting of two parts 2*a* and 2*b*, between which is held a PCB board(s) 3 with a switch 4 and a switch cover 5, which may be transparent, linked to an electrical cord 6, and is also held one end of a connect axis 7, on which a rotatable element 8 is mounted carrying two halves 9*a*, 9*b* of a bush 9, held together by a ring 10 and by a bush shaped cover 11, which may be made of skidproof silicone.

On the connect axis 7 a tube body 12, which may be made of aluminum or another suitable metal, further fixed by means of a screw connector 13, that is fixed to the tube body by means of a small locking screw 14. The tube body 12 comprises two heating elements 22 and the tube body 12 is capped at its end with a tip cover 15 with its fixing pad 16.

The bush 9 formed by two half bushes 9*a*, 9*b* together with the bush shaped cover 11 constitute a rotatable element 8 on which a clamp 17, which may also be made of aluminum or another suitable metal, is fixed. A turning spindle 18 at the base of the clamp 17 allows the clamp 17 to tilt from a closed position in contact with the tube body 12 to an open position whereby the clamp 17 is tilted away from the tube body 12.

The clamp 17 is held in a closed position by means of a spring 19*a* with its spring fixer 19*b*, mounted between the base of the clamp 17 and the rotatable element 8 on which the clamp is fixed. The clamp 17 can be opened with a button 20 covered with a silicone button cover 21.

The heating elements 22 are connected to the main supply by means of the electrical cord 6.

The use of the curling tong according to the invention is simple and straightforward.

After connecting the tong 1 to an electric power source by means of the electrical cord 6, the heating of the tube body 12 is switched on by the switch 4 on the fixed handle 2.

Figure 3:
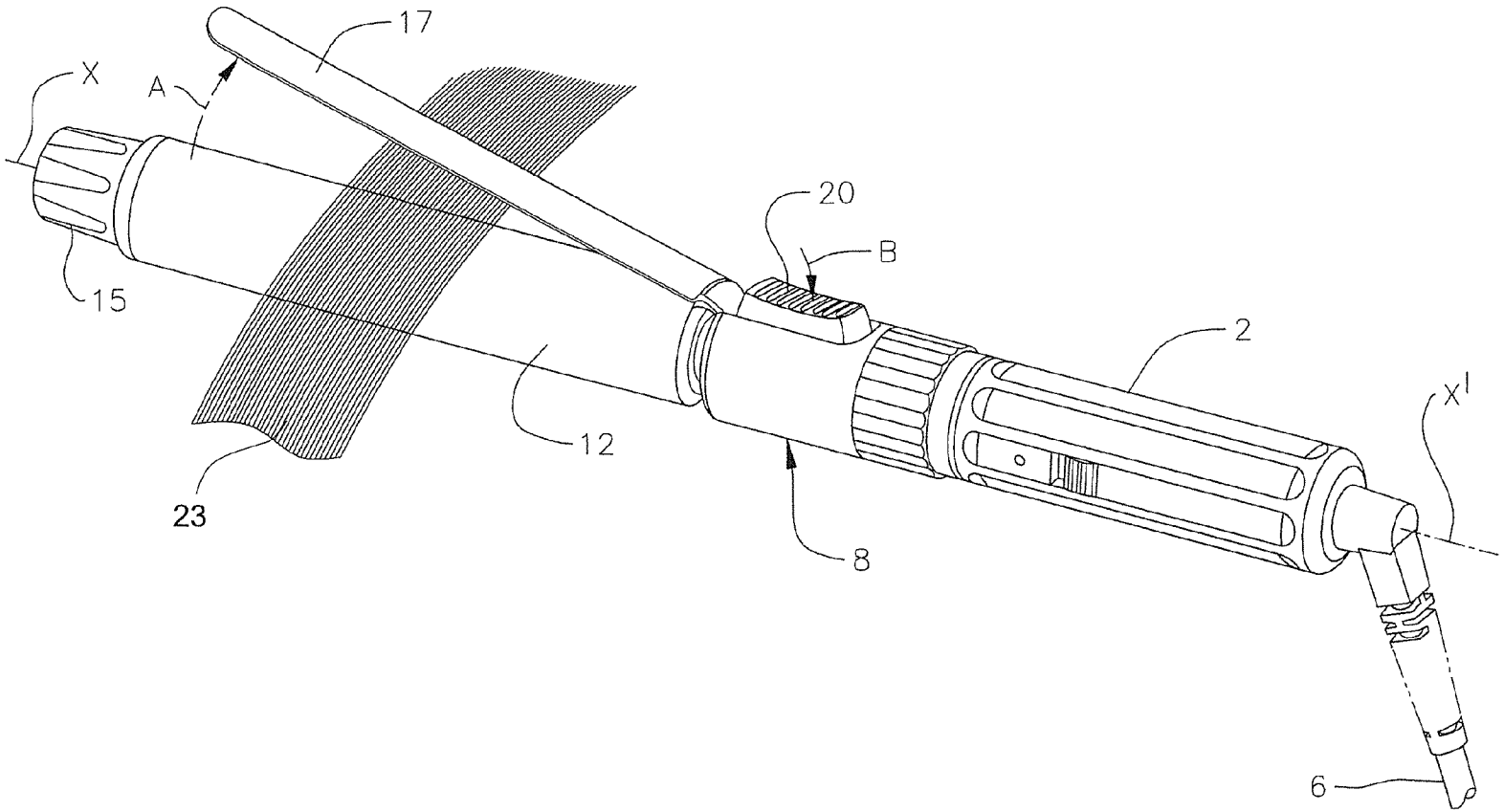
FIGS. 3 and 4 illustrate the use of the curling tong of FIG. 1.

The clamp 17 is tilted upwards as shown by arrow A in FIG. 3 by pressing the button 20 in direction B in FIG. 3, in order to overcome the action of spring 19*a*, and a lock of hair is inserted between the clamp 17 and the tube body 12, after which the button 20 is released so that the clamp 17 is closed due to the action of the spring 19*a*.

The clamp 17 is now rotated around the longitudinal axis X-X' of the tube body 12 by rotating the ring 10 between thumb and index finger. During this rotation the clamp 17 is held in close contact with the tube body 12 by means of the spring 18 and is revolved around the tube body 12 so as to wind the lock of hair 23 around the heated tube body 12, while holding the fixed handle 2 and the tube body 12 attached to it in a fixed position.

Figure 4:
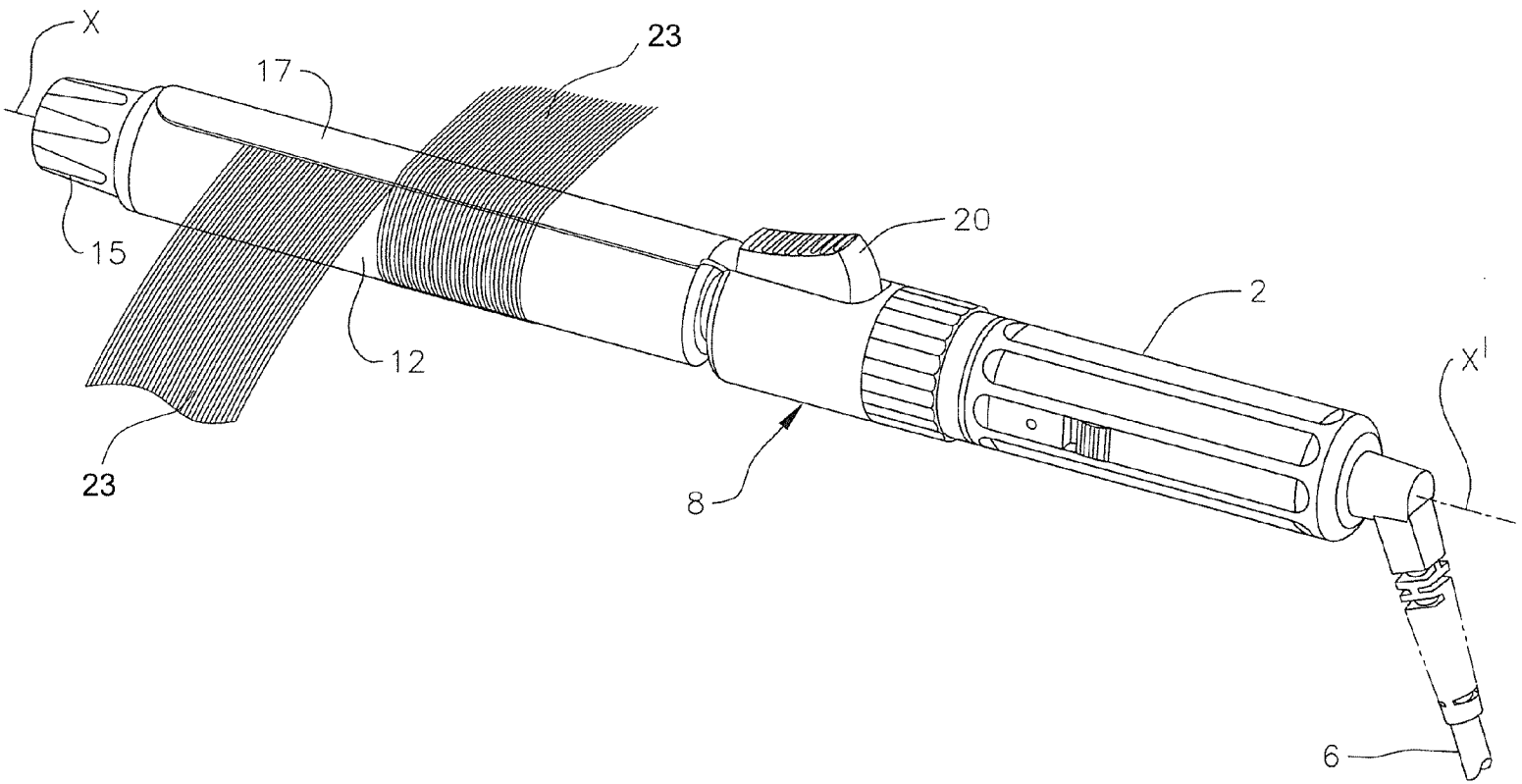

The ring 10 can rotate 360° and more so that when the ring 10 is rotated, the lock of hair 23 is curled around the tube body 12 in multiple windings as shown in FIG. 4, during which the lock of hair 23 is heated by the tube body 12 which results in fixing a curly pattern in the lock of hair 23.

After the heated tube body 12 has generated curls in the lock of hair 23, the clamp 17 is tilted up again by pressing the button 20, thereby releasing the curled lock of hair 23 without moving the tube body 12 itself.

As illustrated in the embodiments shown in FIGS. 1 to 4, the tube body 12 may have a cylindrical shape with a circular cross-section perpendicular to its longitudinal axis. Alternate embodiments may have tube bodies with different shapes e.g. with a conical shape or a tube body 12 with a knurled circular cross-section 24 with ribs and grooves stretching in the longitudinal direction X-X' of the tube body 12, (as shown in the enlarged view in FIG. 1),or with any other shape deemed useful for the heated tube body 12.

The heated tube body 12 with a circular cross-section will result in evenly curled hair, while a knurled circular cross-section will result in a extra wavy curl of the treated hair.

The bush shaped cover 11 capable of rotating the clamp 17, can be realized in a skid-proof material, such as a silicone or in other materials, with a finishing that is not smooth.

Although the embodiment described is provided with a ring 10 which is freely rotatable by hand, it is not excluded to provide the curling tong 1 with driving means to rotate the ring 10 supporting the clamp 17.

The present invention is in no way limited to the form of embodiment described by way of an example and represented in the figures, however, such an improved curling tong can be realized in various forms without departing from the scope of the invention.

What is claimed is:

1. A hair curling tong (1) comprising:

a fixed handle (2);

a fixed heated tube body (12) coupled to the fixed handle (2), the fixed handle (2) and the fixed heated tube body (12) defining a longitudinal axis (X-X'); and a rotatable element (8) rotatably fixed to the hair curling tong (1) and disposed between the fixed handle (2) and the fixed heated tube body (12), the rotatable element (8) having a clamp (17) tiltable between a closed position, wherein the clamp (17) is held in contact with the tube body (12) by means of a spring (18), and an open position, wherein the clamp is tilted away from the tube body (12) by means of a button (20) coupled to the spring, and wherein the clamp (17) is rotatable relative to the fixed handle (2) and the fixed heated tube body (12) through at least one complete revolution around the longitudinal axis (X-X').

2. The hair curling tong (1) according to claim 1, wherein the rotatable element (8) comprises a bush (9) held together by a ring (10) with a cylindrical grip, situated adjacent to the fixed handle (2), the rotatable element (8) being rotatable with respect to the fixed handle (2) by fingers of the same hand that holds the fixed handle (2).

3. The hair curling tong (1) according to claim 2, wherein at least one of the ring (10) and the cylindrical grip is made of a thermally insulating material.

4. The hair curling tong (1) according to claim 3, wherein at least one of the ring and the cylindrical grip is made of a silicone.

5. The hair curling tong according to any one of claims 1 to 4, wherein the clamp (17) is made of a metal.

6. The hair curling tong (1) according to any one of claims 1 to 4, wherein the clamp (17) is made of a thermally resistant synthetic material.

7. The hair curling tong (1) according to claim 1, wherein the clamp (17) can be locked or unlocked by releasing or pushing a button (20).

8. The hair curling tong (1) according to claim 1, wherein the fixed heated tube body (12) comprises a circular cross-section perpendicular to its longitudinal axis (X-X').

9. The hair curling tong (1) according to claim 1, wherein the fixed heated tube body (12) comprises a knurled surface (24).

10. The hair curling tong (1) according to claim 1, further comprising a bush shaped cover (11) comprising a skid-proof material.

11. The hair curling tong (1) according to claim 10, wherein the bush shaped cover (11) comprises a silicone material.

12. The hair curling tong (1) according to claim 10, wherein the bush shaped cover (11) comprises a finishing that is not smooth.

* * * * *